US005779153A

United States Patent [19]

Wu

[11] Patent Number: 5,779,153

[45] Date of Patent: Jul. 14, 1998

[54] NOZZLE FOR PAINT SPRAY GUNS

[75] Inventor: Jackie Wu, Taipei Hsien, Taiwan

[73] Assignee: Chia Chun Enterprises Co., Ltd., Taipei Hsien, Japan

[21] Appl. No.: 749,667

[22] Filed: Nov. 15, 1996

[51] Int. Cl.[6] ..... B05B 1/28; B05B 7/06

[52] U.S. Cl. ..... 239/296; 239/424.5

[58] Field of Search ..... 239/290, 291, 239/296, 298, 424, 424.5

[56] References Cited

U.S. PATENT DOCUMENTS

| | | | |
|---|---|---|---|
| 3,907,202 | 9/1975 | Binoche | 239/424.5 X |
| 4,392,617 | 7/1983 | Bakos et al. | 239/290 |
| 5,435,491 | 7/1995 | Sakuma | 239/424.5 X |

*Primary Examiner*—Andres Kashnikow
*Assistant Examiner*—Robin O. Evans
*Attorney, Agent, or Firm*—Bacon & Thomas

[57] ABSTRACT

A nozzle for paint spray guns, including a tubular nozzle body having a conical nozzle tip at one end and an outer thread at an opposite end, a first collar tightly mounted around the tubular nozzle body and having a plurality of axial through holes; and, a second collar tightly mounted around the tubular nozzle body between the first collar and the outer thread of the tubular nozzle body and having a plurality of axial through holes which are not in longitudinal alignment with the through holes of the first collar and through which compressed currents of air are driven toward the through holes of the first collar, after a mixing process at the annular space defined between the first collar and the second collar, to mix with the output spray of paint into a good atomization of paint.

1 Claim, 3 Drawing Sheets

NOZZLE FOR PAINT SPRAY GUNS

BACKGROUND OF THE INVENTION

The present invention relates to nozzles for paint spray guns, and relates more particularly to such a nozzle which enables the output spray of paint to be mixed very well with compressed air and to form a good atomization of paint flow.

FIG. 3 shows the structure of a regular nozzle for paint spray guns. This structure of nozzle 7 comprises a tubular nozzle body 71 having a front end terminating in a conical nozzle tip 711 and a rear end terminating in an outer thread for mounting, and a collar 72 tightly mounted around the tubular nozzle body 71 near the conical nozzle tip 711. The collar 72 has a plurality of axial through holes 721 in parallel to the tubular nozzle body 71. When a spray of paint is driven out of the conical nozzle tip 711, currents of air are simultaneously driven out of the through holes 721 of the collar 72 to mix with the output spray of paint. Because the currents of air which are driven out of the through holes 721 of the collar 72 have different pressure, the output spray of paint cannot be forced into a good atomization of paint uniformly.

SUMMARY OF THE INVENTION

The present invention has been accomplished to provide a nozzle for paint spray guns which eliminates the aforesaid problem. According to the present invention, two collars are mounted around the tubular nozzle body and spaced by an annular space, and axial through holes are respectively made through the collars for permitting compressed currents of air to be mixed in the annular space between the two collars and then forced out of the axial through holes of the front collar to further mix with the output spray of paint into a good atomization of paint uniformly.

DETAILED DESCRIPTION OF THE PREFERRED EMBODIMENT

Figure 1:
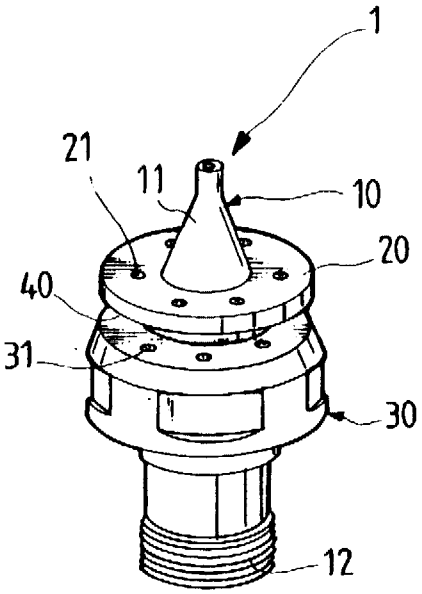
FIG. 1 is an elevational view of a nozzle for paint spray guns according to the present invention.

Referring to FIG. 1, the nozzle, referenced by 1, comprises a tubular nozzle body 10 having a front end terminating in a conical nozzle tip 11 and a rear end terminating in an outer thread 12, a first collar 20 tightly mounted around the tubular nozzle body 10 near the conical nozzle tip 11 and having a plurality of axial through holes 21 in parallel to the tubular nozzle body 10, a second collar 30 tightly mounted around the tubular nozzle body 10 between the first collar 20 and the outer thread 12 and having a plurality of axial air inlets (through holes) 31 in parallel to the tubular nozzle body 10, and an annular space 40 defined around the tubular nozzle body 10 between the first collar 20 and the second collar 30. The axial through holes 21 of the first collar. 20 are not in longitudinal alignment with the axial air inlets 31 of the second collar 30.

Figure 2:
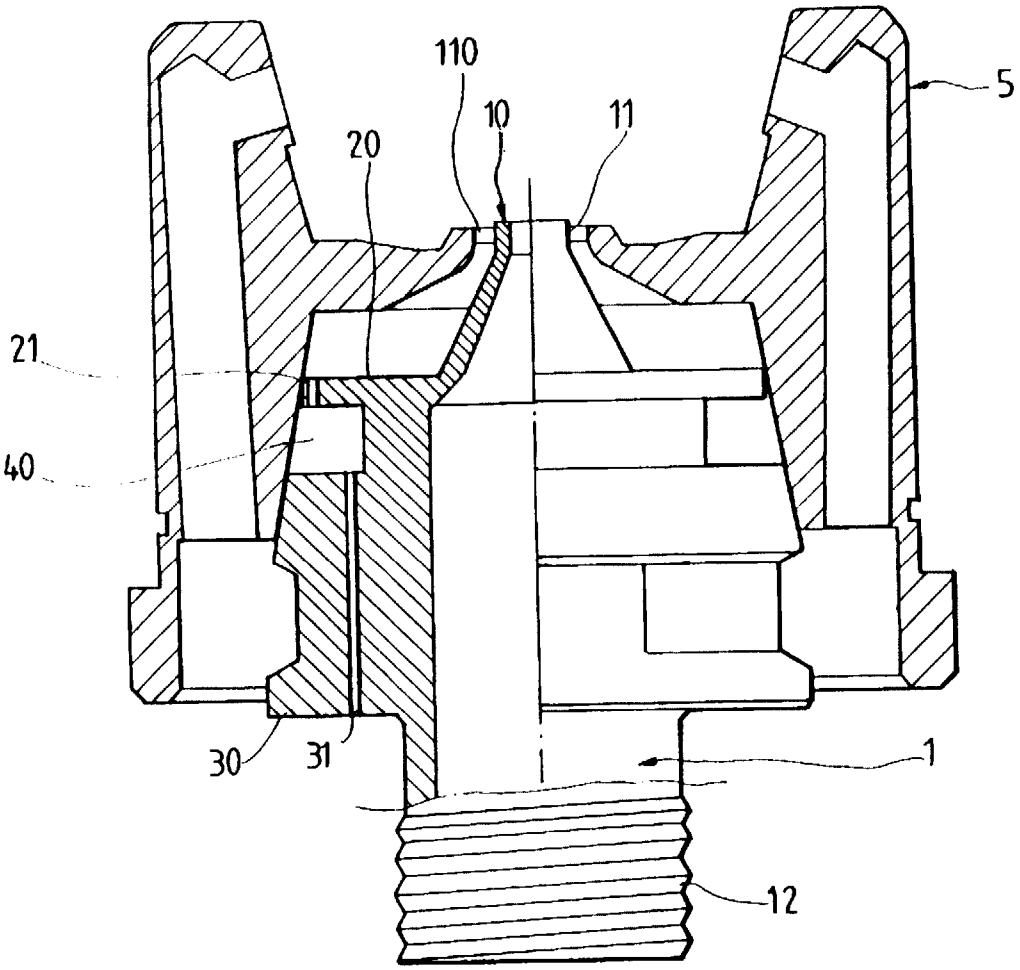
FIG. 2 is a sectional view in an enlarged scale of the present invention, showing the nozzle fastened to the rotary cap; and, FIG. 3 is a sectional view of a nozzle for paint spray guns according to the prior art.
Figure 3:
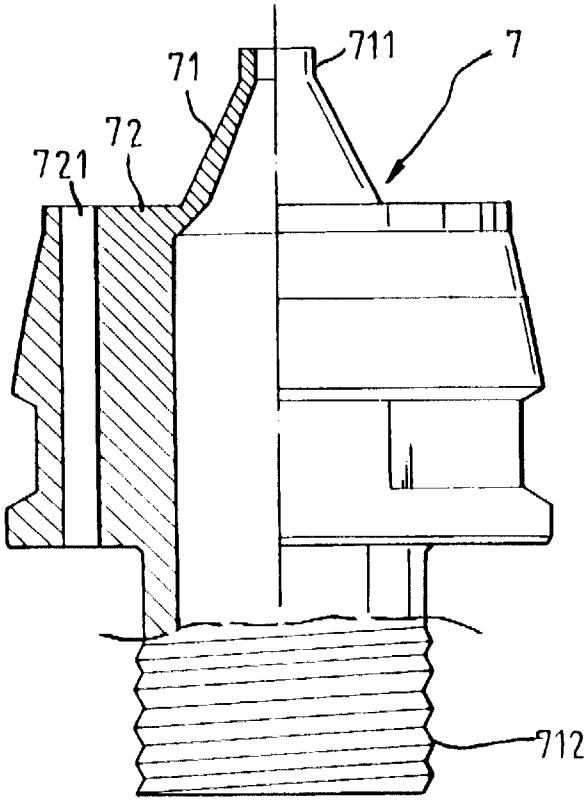
Fig 3 PRIOR ART

Referring to FIG. 2, when in use, the outer thread 12 of the nozzle 1 is threaded into an inner thread in a part of the paint spray gun (not shown), and a rotary cap 5 is covered on the nozzle 1. When the pain spray gun is operated, paint is driven out of the tubular nozzle body 10 through the conical nozzle tip 11, and at the same time currents of air of a certain pressure (about 4 kg/cm$^2$) are driven toward the second collar 30 from different directions. At this stage, the currents of air have uneven pressure and are forced into the air inlets 31 of the second collar 30 toward the first collar 20. Therefore, the pressure value of air in the air inlets 31 is uneven. When currents of air pass out of the air inlets 31 of the second collar 30, they are immediately stopped by the first collar 20, and forced to mix with one another and to balance the pressure, and then well mixed currents of air are forced to flow through the through holes 21 of the first collar 20 and then out of the rotary cap 5 through the gap 110 in the rotary cap 5 around the conical nozzle tip 11, thereby causing the output spray of paint to be mixed with the output spray of air and to form a good atomization of paint flow.

While only one embodiment of the present invention has been shown and described, it will be understood that various modifications and changes could be made thereunto without departing from the spirit and scope of the invention disclosed.

What the invention claimed is:

1. A nozzle for paint spray guns, comprising:

a tubular nozzle body having a front end terminating in a conical nozzle tip and a rear end terminating in an outer thread for mounting;

a first collar tightly mounted around said tubular nozzle body near said conical nozzle tip and having a plurality of axial through holes in parallel to said tubular nozzle body; and, a second collar tightly mounted around said tubular nozzle body between said first collar and the outer thread of said tubular nozzle body and having a plurality of axial through holes in parallel to said tubular nozzle body, said second collar defining with said first collar an annular space around said tubular nozzle body, the axial through holes of said first collar being not in longitudinal alignment with the axial air inlets of said second collar.

* * * * *